US012422232B2

(12) United States Patent
Binek

(10) Patent No.: US 12,422,232 B2
(45) Date of Patent: Sep. 23, 2025

(54) BULLET SYSTEM WITH MULTIPLE DRAG-REDUCING CAPABILITIES

(71) Applicant: Next Dynamics Corp., Montreal (CA)

(72) Inventor: Anthony A Binek, Glastonbury, CT (US)

(73) Assignee: Next Dynamics Corp, Montreal (CA)

( * ) Notice: Subject to any disclaimer, the term of this patent is extended or adjusted under 35 U.S.C. 154(b) by 0 days.

(21) Appl. No.: 18/574,907

(22) PCT Filed: Jun. 29, 2022

(86) PCT No.: PCT/CA2022/051037
§ 371 (c)(1),
(2) Date: Dec. 28, 2023

(87) PCT Pub. No.: WO2023/272387
PCT Pub. Date: Jan. 5, 2023

(65) Prior Publication Data

US 2024/0344814 A1 Oct. 17, 2024

Related U.S. Application Data

(60) Provisional application No. 63/202,898, filed on Jun. 29, 2021.

(51) Int. Cl.
*F42B 10/40* (2006.01)

(52) U.S. Cl.
CPC ..... *F42B 10/40* (2013.01)

(58) Field of Classification Search
CPC .. F42B 5/145; F42B 5/10; F42B 10/40; F42B 10/38; F42B 10/34
(Continued)

(56) References Cited

U.S. PATENT DOCUMENTS 1,376,316 A 4/1921 Chilowsky
2,624,281 A * 1/1953 McNally ..... F02K 7/08 60/201
(Continued)

FOREIGN PATENT DOCUMENTS

CA 30578656 10/2018
DE 2856286 7/1980
(Continued)

OTHER PUBLICATIONS

U.S. Pat. No. 466,056; Issued Dec. 29, 1891 to Bott.
Written Opinion from PCT/CA2022/051037.

*Primary Examiner* — Reginald S Tillman, Jr.
(74) *Attorney, Agent, or Firm* — Stephen T. Scherrer; Monique A. Morneault; Scherrer Patent & Trademark Law, P.C.

(57) ABSTRACT

A bullet system (1) for use with a weapon upon firing, the bullet system (1) including a main body (3) acting as a projectile, as well as a first, second and third drag-reducing assemblies (5*a*, 5*b*, 5*c*) for providing the bullet system (1) with reductions of base drag, frontal drag and skin drag, during flight trajectory, the drag-reducing assemblies (5*a*, 5*b*, 5*c*) being fluidly connectable to one another via a common longitudinal channel (11), and the most frontward (5*b*) of said drag-reducing assemblies (5*a*, 5*b*, 5*c*) being provided with a material capable of being converted into an operative vapor discharge to be released from an orifice located at the bullet tip for covering the outer surface of the main body (3) of the bullet system (1) with said operative vapor discharge during flight, and thus, reducing the skin and frontal drag of the bullet system (1) during flight; wherein the first drag-reducing assembly (5*a*) is being
(Continued)

provided about a rearward portion of the main body (3) for providing the bullet (1) with a reduction of base drag during flight trajectory.

20 Claims, 7 Drawing Sheets

(58) Field of Classification Search
USPC ..... 102/490, 440
See application file for complete search history.

(56) References Cited

U.S. PATENT DOCUMENTS

| | | | | |
|---|---|---|---|---|
| 2,941,469 | A | | 6/1960 | Barnhart |
| 3,345,948 | A | | 10/1967 | Sarvis |
| 3,754,507 | A | | 8/1973 | Dillinger et al. |
| 3,913,487 | A | | 10/1975 | Scherr et al. |
| 3,988,990 | A | | 11/1976 | MacDonald, Jr. et al. |
| 3,995,558 | A | | 12/1976 | Travor et al. |
| 4,003,313 | A | | 1/1977 | Puchalski |
| 4,091,732 | A | | 5/1978 | Schadow |
| 4,108,073 | A | | 8/1978 | Davis |
| 4,133,265 | A | | 1/1979 | Diesinger et al. |
| 4,213,393 | A | | 7/1980 | Gunners et al. |
| 4,528,911 | A | | 7/1985 | DePhillipo et al. |
| 4,742,774 | A | | 5/1988 | Flatau |
| 5,058,503 | A | | 10/1991 | Adams |
| 5,067,406 | A | * | 11/1991 | Olson ..... F42B 10/34 102/374 |
| 5,353,711 | A | | 10/1994 | Botticelli et al. |
| 5,544,586 | A | * | 8/1996 | Huerta ..... F02K 7/105 102/374 |
| 6,186,072 | B1 | | 2/2001 | Hickerson, Jr. et al. |
| 6,581,522 | B1 | | 6/2003 | Julien et al. |
| 7,171,905 | B2 | | 2/2007 | Hirt et al. |
| 7,823,510 | B1 | | 11/2010 | Hobart et al. |
| 8,122,833 | B2 | | 2/2012 | Nielson et al. |
| 8,291,828 | B2 | | 10/2012 | Glasser |
| 8,511,233 | B2 | | 8/2013 | Nilsson |
| 11,162,768 | B2 | | 11/2021 | Binek et al. |
| 11,674,779 | B2 | | 6/2023 | Binek et al. |
| 2008/0035008 | A1 | | 2/2008 | Riess et al. |
| 2016/0131465 | A1 | | 5/2016 | Harrison |
| 2019/0145745 | A1 | | 5/2019 | Graber |
| 2021/0302141 | A1 | | 9/2021 | Kennedy |

FOREIGN PATENT DOCUMENTS

| | | |
|---|---|---|
| DE | 3442973 | 1/1986 |
| EP | 2811256 | 12/2014 |
| WO | 1991011676 | 8/1991 |
| WO | 2016131158 | 8/2016 |

* cited by examiner

BULLET SYSTEM WITH MULTIPLE DRAG-REDUCING CAPABILITIES

FIELD OF THE INVENTION

The present invention relates to a projectile system (or "bullet system", or simply "bullet"), hereinafter referred to also as "Starchaser", "StarChaser" and/or simply "SC" (trademark expression(s) used and/or own by the Applicant(s)). More particularly, the present invention relates to a new and improved projectile system for use with various types of firearms, and also relates to a method for assembling the same, and to corresponding methods of manufacturing, operating and/or use associated thereto.

BACKGROUND

Firearms and the various types of ammunitions used therewith (ex. projectiles, bullets, etc.), are well known in the art, and have been used for many years.

It is also known that a conventional bullet in flight forms a partial vacuum immediately therebehind. This partial vacuum or low pressure area creates a force which acts on the projectile in a direction opposite to its motion, thereby lessening the flight velocity of the projectile. This force is commonly referred to as "base drag". Drag may be defined as that force acting on the projectile in a direction opposite to its motion. Base drag is that drag acting on the projectile at its base.

In regards to conventional projectiles (or "bullets"), it is also known that they are affected by a pressure difference that occurs on the rearward face (i.e. "base drag"). This drop in pressure causes drag and can generate flight instability (ex. turbulence, etc.). These factors will reduce the precision and accuracy of a projectile grouping, for example.

It is also well known that ammunitions (ex. projectiles, bullets, etc.), have evolved over the years, and have been the object of various patent applications.

For example, known to the Applicant(s) is U.S. Pat. No. 3,913,487, granted on Oct. 21, 1975, in the name of SCHERR, and relating to a "projectile". This document describes a projectile of the type adapted to be propelled from a gun barrel by expanding gas. The projectile is formed with a chamber in its base and an outlet passage leading from the chamber through the base. The chamber is of nonuniform cross-sectional area with the cross-sectional area generally diminishing from a wall at the nose end of the chamber to the outlet passage. The wall of the nose end of the chamber may vary in shape from concave through flat to convex. The chamber may vary in shape from generally hemispheric to generally conical. In a modified form of the invention, at least two chambers are formed in the base and connected in series.

U.S. Pat. No. 7,823,510 B1, granted on Nov. 2, 2010, in the name of HOBART et al., relates to an "extended range projectile". This document describes a projectile and method of extending the range of the projectile. The projectile includes a storage tank operable to release a working fluid through an exhaust manifold to at least partially fill a wake aft of the projectile during projectile flight.

U.S. Pat. No. 3,345,948, granted on Oct. 10, 1967, in the name of SARVIS, relates to a "projectile". This document describes a projectile that comprises a body having a chamber or cavity therein, closed at the rear and open at the front. A gas generating charge is disposed in the rear end portion of the cavity. The charge may be of any type well known to one skilled in the munitions art which will produce hot combustion gases while doing substantially little or no damage to the body.

U.S. Pat. No. 4,133,265, granted on Jan. 9, 1979, in the name of DIESINGER et al., relates to a "training projectile". This document describes a training projectile having an auxiliary drive mechanism for counteracting the aerodynamic resistance to which the projectile is exposed during the training flight phase of projectile travel. The auxiliary drive mechanism preferably is in the form of a rocket or jet drive. The training projectile is also provided with a mass so that the ratio of the resultant axial force to the mass of the training projectile is at least approximately equal to the ratio of the resistance force to the mass of a corresponding live projectile during the training flight phase.

U.S. Pat. No. 5,058,503, granted on Oct. 22, 1991, in the name of ADAMS, III, relates to an "aerodynamic projectile". This document describes a solid projectile having identical tapered leading and trailing sections that are integral with and which extend from opposite ends of a central bearing section having a constant diameter throughout its length.

International patent application No. PCT/CH2016/000028, made public on Aug. 25, 2016, under WO/2016/131158A1, in the name of MUSTER et al., relates to a "tracer ammunition". This document describes a tracer ammunition for tracking the trajectory and/or the impact of projectiles in the target, said tracer ammunition containing mostly pyrotechnics. Said pyrotechnics have various disadvantages, wherein the main disadvantage is the further combustion of the pyrotechnics even after penetration of the projectile in the target. This causes an increased risk of fire and an acute risk of injury. A mixture according to the invention of light metal and a carbon-containing substrate ignites during the firing of a projectile and burns during its flight by effect of the air oxygen introduced into the combustion chamber via tear-off edges and produces a tracer that extinguishes in the target.

Also known to the Applicant(s) are the following documents: U.S. Pat. No. 466,056; U.S. Pat. Nos. 2,941,469; 3,754,507; 3,988,990; 3,995,558; 4,003,313; 4,091,732; 4,108,073; 4,213,393; 4,528,911; 4,742,774; 5,353,711; 6,186,072 B1; U.S. Pat. No. 6,581,522 B1; U.S. Pat. No. 7,171,905 B2; U.S. Pat. No. 8,122,833 B2; U.S. Pat. No. 8,291,828 B2; U.S. Pat. No. 8,511,233 B2; US 2008/0035008 A1; US 2016/0131465 A1; EP 2,811,256 A1; and WO 1991/011676 A2.

Also known in the art is the technology having been developed by the very same main inventor of the present patent application, and by the same Assignee, namely, the technology being described in corresponding U.S. Pat. No. 11,162,768 B2, granted on Nov. 2, 2021, in the name of BINEK et al., and relating to an "improved bullet", the content of which is incorporated herein by reference. This document describes namely a bullet configured to be propelled by a blast of a cartridge, the bullet comprising a main body provided with an internal body cavity and having a frontward section and a rearward section provided with an opening in fluid communication with the internal body cavity, the internal body cavity by means of the opening being capable of recovering a portion of gun gas resulting from the blast of the cartridge.

Despite these known improvements over the years, there is a need to continue innovating and finding better and/or different ways of firing projectiles so as to improve ballistic performances, in terms of accuracy, range and terminal energy.

Thus, it would be particularly useful to be able to provide an improved bullet system which, by virtue of its design and components, would be able to overcome or at least minimize some of the known drawbacks (ex. accuracy, drag, instability, limited range, etc.) associated with conventional bullets.

SUMMARY OF THE INVENTION

An object of the present invention is to provide a new projectile (hereinafter referred to also simply as "bullet") which, by virtue of its design and components, is intended to satisfy the above-mentioned need and which is thus an improvement over other related bullets, corresponding weapons, associated accessories and/or firing devices, systems, assemblies and/or methods known in the prior art.

In accordance with the present invention, the above main object is achieved, as will be easily understood, with a bullet (and/or a corresponding weapon and/or associated accessory provided with at least one such bullet, as well as corresponding kits for assembling the same (ex. bullet, weapon, etc.), and corresponding methods of manufacturing, assembling, operating, use, etc.), such as the one(s) briefly described herein and such as the ones exemplified in the accompanying drawings.

More particularly, and according to one aspect of the present invention, an objective is to provide a bullet system for use with a cartridge for propelling out from a barrel of a weapon upon firing, the bullet system comprising:

- a main body acting as a projectile;
- a first drag-reducing assembly provided about a rearward portion of the main body, for providing the bullet with a reduction of base drag during flight trajectory;
- a second drag-reducing assembly provided about a frontward portion of the main body, for providing the bullet with a reduction of frontal drag during flight trajectory; and
- a third drag-reducing assembly provided about an internal portion of the main body, for providing the bullet with a reduction of skin drag during flight trajectory, the drag-reducing assemblies being fluidly connectable to one another via at least one corresponding channel, and at least one of said drag-reducing assemblies being provided with a material capable of being converted into an operative vapor discharge to be released from a corresponding orifice of the main body of the bullet system for covering the main body of the bullet system with said operative vapor discharge during flight, and thus, reducing an associated skin drag of the bullet system during flight.

It is important to note that one and/or several of the aforementioned drag-reducing assemblies may be integrated into a same and/or single given drag-reducing assembly.

According to another aspect of the present invention, there is also provided a kit with corresponding components for assembling the above-mentioned bullet.

According to another aspect of the present invention, there is also provided a corresponding weapon (ex. rifle, etc.) and/or an associated accessory (ex. loader, etc.) provided with at least one of the above-mentioned bullet(s), and preferably, with a plurality of such bullets.

According to another aspect of the present invention, there is also provided a kit with corresponding components for assembling the above-mentioned weapon.

According to another aspect of the present invention, there is also provided a weapon system comprising the above-mentioned bullet(s) and/or weapon.

According to another aspect of the present invention, there is also provided a kit with corresponding components for assembling the above-mentioned weapon system.

According to another aspect of the present invention, there is also provided a method of reducing drag from a bullet being propelled out of a barrel of a weapon upon firing with the above-mentioned bullet system.

According to another aspect of the present invention, there is also provided a method of reducing drag from a bullet during flight thereof with the above-mentioned bullet system.

According to another aspect of the present invention, there is also provided a method of reducing base drag from a bullet during flight thereof with the above-mentioned bullet system.

According to another aspect of the present invention, there is also provided a method of reducing frontal drag from a bullet during flight thereof with the above-mentioned bullet system.

According to another aspect of the present invention, there is also provided a method of reducing skin drag from a bullet during flight thereof with the above-mentioned bullet system.

According to another aspect of the present invention, there is also provided a method of manufacturing (ex. making, creating, producing, generating, assembling, etc.) the above-mentioned bullet, bullet system, weapon, weapon system, part(s) thereof, component(s) thereof and/or associated accessory (ies).

According to another aspect of the present invention, there is also provided a method of operating and/or using the above-mentioned bullet, bullet system, weapon, weapon system, part(s) thereof, component(s) thereof and/or associated accessory (ies).

According to another aspect of the present invention, there is also provided a set of components for interchanging with components of the above-mentioned kit(s).

According to another aspect of the present invention, there is also provided a method of assembling components of the above-mentioned kit(s) and/or set(s).

According to another aspect of the present invention, there is also provided a method of doing business with the above-mentioned bullet, bullet system, weapon, weapon system, part(s) thereof, component(s) thereof, associated accessory (ies), method(s), kit(s), set(s) and/or any other possible aspects(s) thereof.

According to another aspect of the present invention, there is also provided a bullet (ex. a blank and/or body with hollowed portion(s)) having been obtained and/or processed (modified, altered, etc.) with the above-mentioned method (s), kit, set, system, etc.

The objects, advantages and other features of the present invention will become more apparent upon reading of the following non-restrictive description of preferred embodiments thereof, given for the purpose of exemplification only, with reference to the accompanying drawings.

BRIEF DESCRIPTION OF THE DRAWING(S)

DETAILED DESCRIPTION OF PREFERRED EMBODIMENTS OF THE INVENTION

Figure 1:
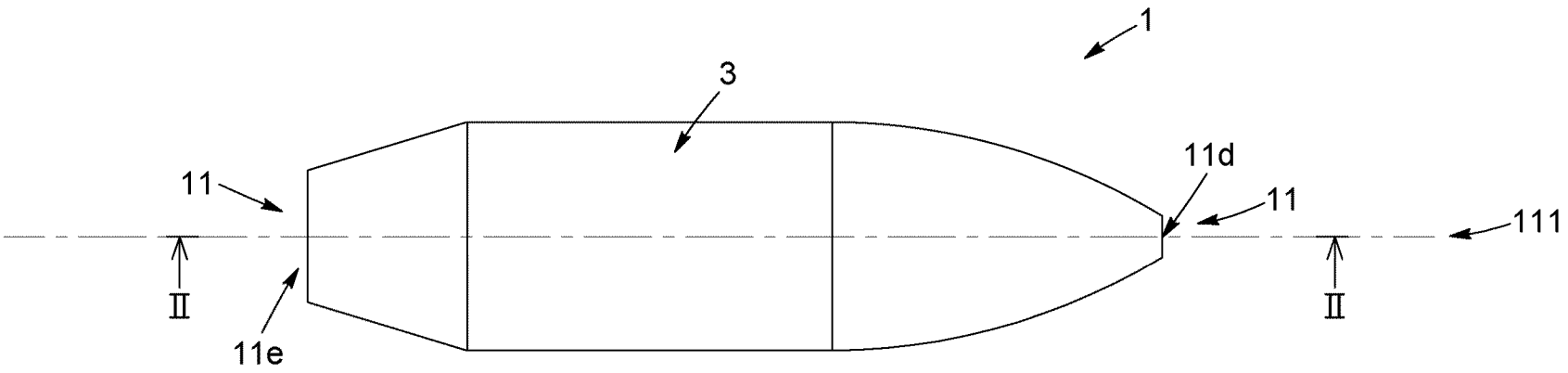
FIG. 1 is a side view of a schematic representation of a bullet according to a possible embodiment of the present bullet system.
Figure 2:
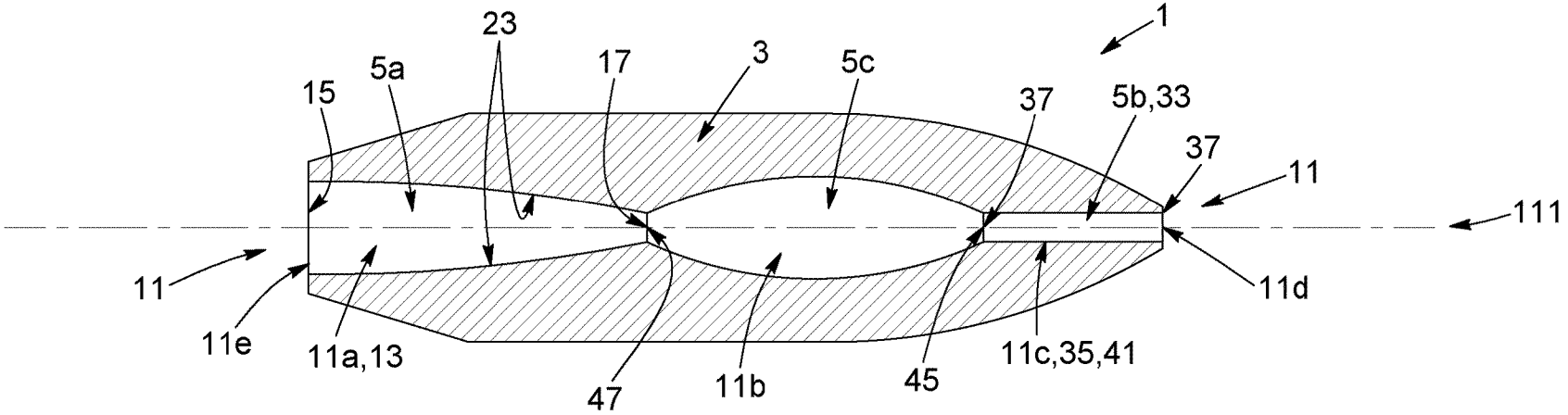
FIG. 2 is a cross-sectional view taken along plane II-II of FIG. 1, in order to better illustrate possible internal components and features of the bullet.
Figure 3:
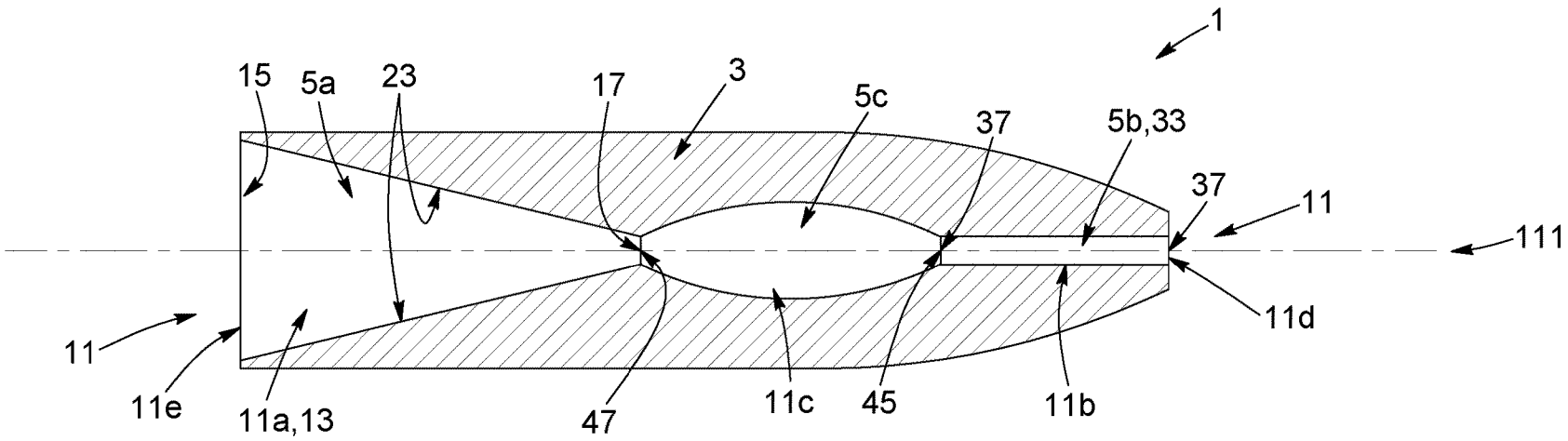
FIG. 3 is a cross-sectional view of a schematic representation of a bullet according to another possible embodiment of the present bullet system.
Figure 4:
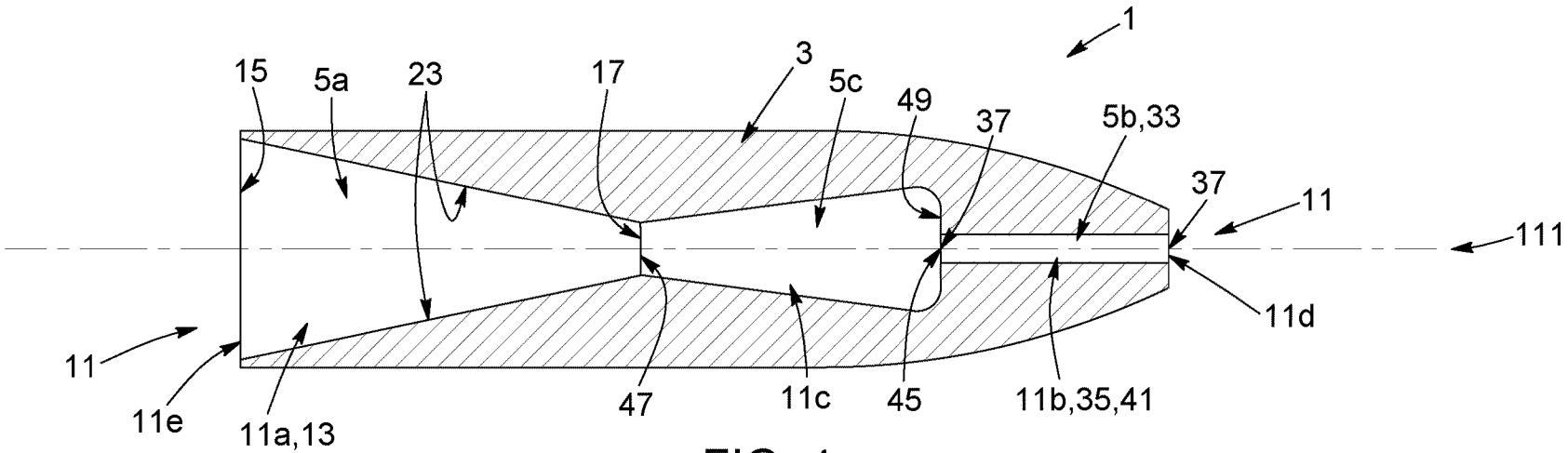
FIG. 4 is a cross-sectional view of a schematic representation of a bullet according to yet another possible embodiment of the present bullet system.
Figure 5:
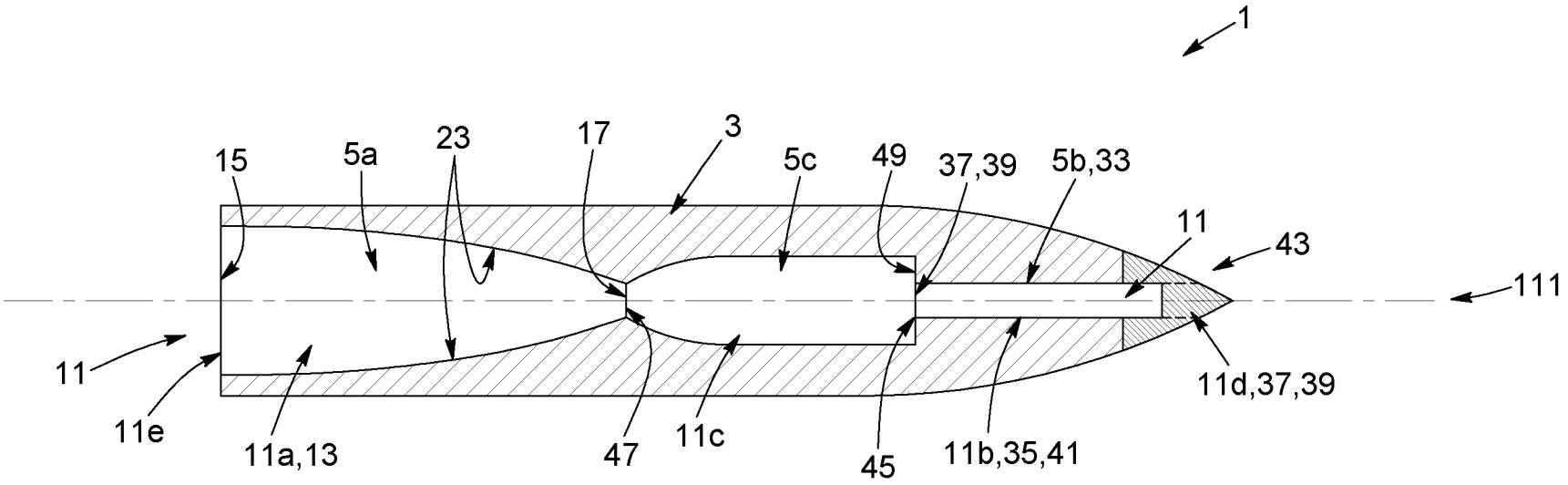
FIG. 5 is a cross-sectional view of a schematic representation of a bullet according to yet another possible embodiment of the present bullet system.
Figure 6:
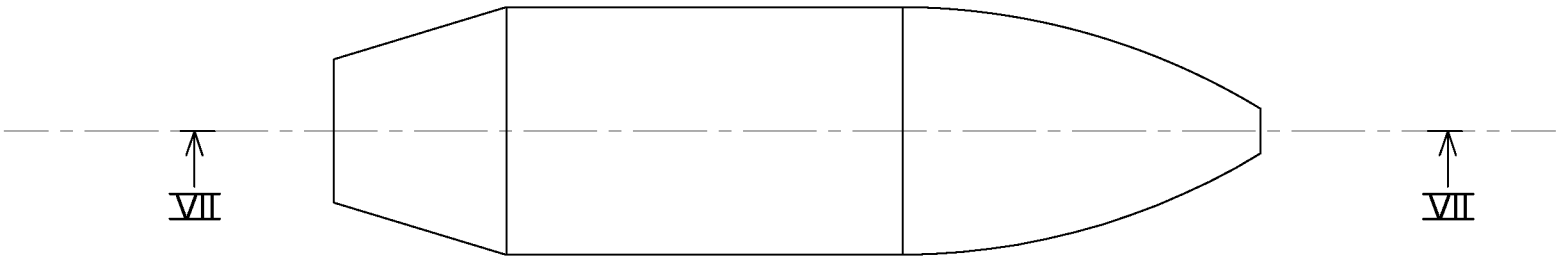
FIGS. 6-10 are repetitive views of FIGS. 1-5, deprived of any reference numbers, in order to better appreciate the various possible internal components and features according the different embodiments being illustrated in the first set of figures.
Figure 7:
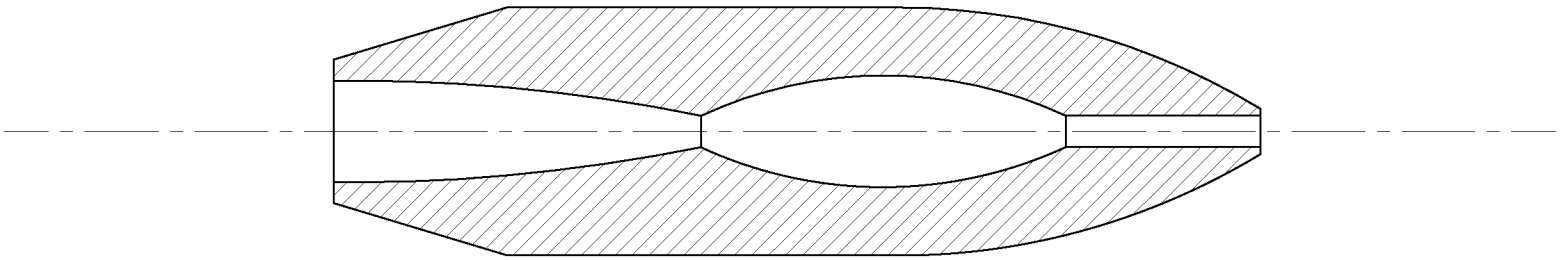
Figure 8:
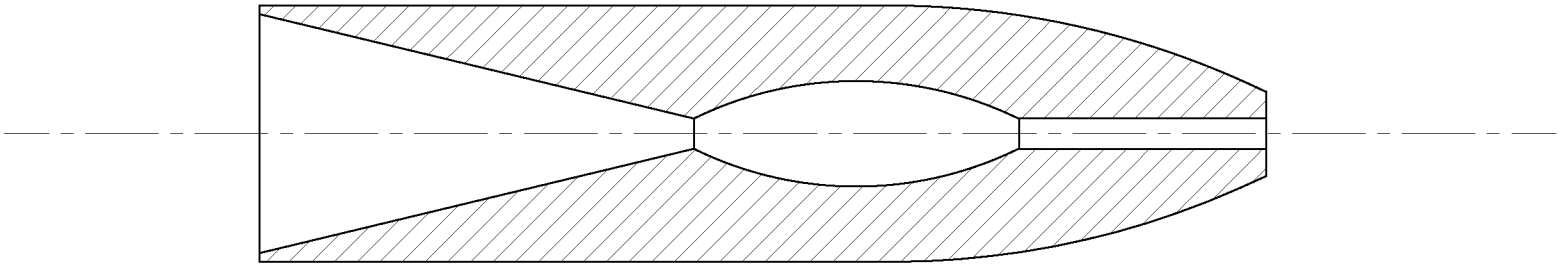
Figure 9:
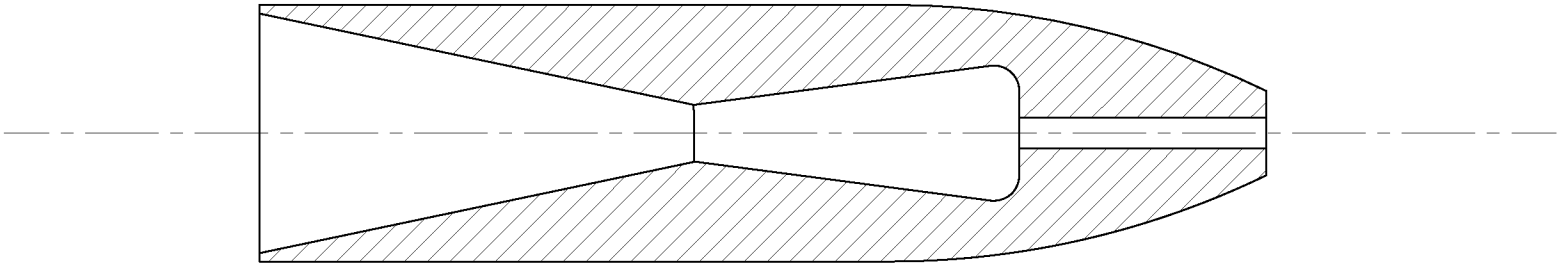
Figure 10:
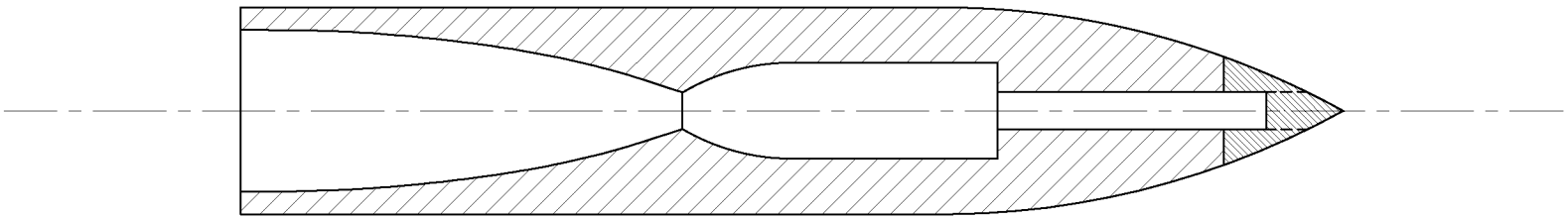
Figure 11:
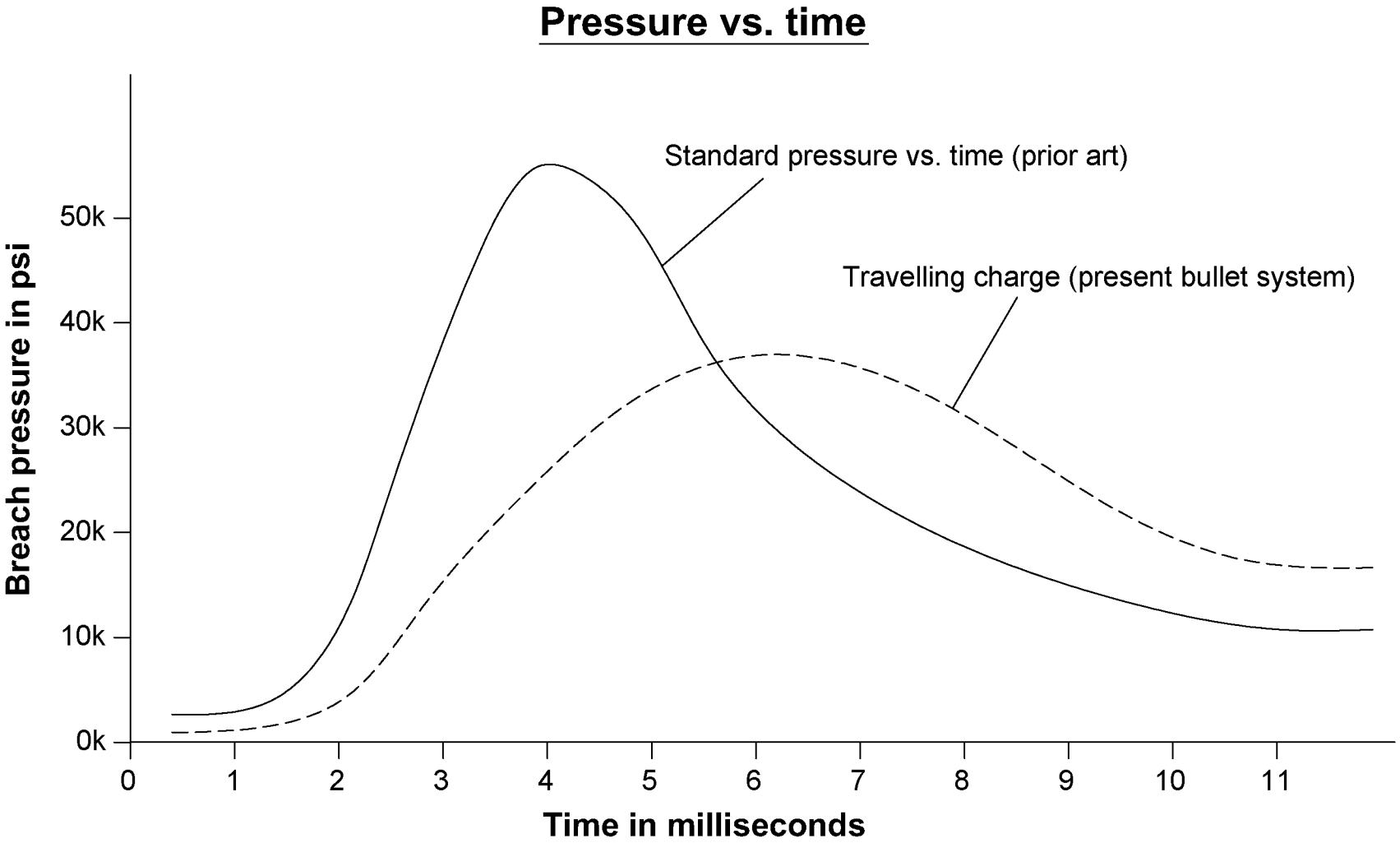
FIG. 11 is graphical representation of "pressure versus time" in order to better contrast behavior of a conventional bullet versus behavior and associated "travelling charge" of a bullet according to a possible embodiment of the present bullet system.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed as a "projectile" (ex. "bullet", etc.) for use with various types of weapons, such as rifles and the like, it may be used with other types of objects, and in other fields, as apparent to a person skilled in the art. For this reason, expressions such as "projectile", "bullet", "weapon", "rifle", etc., used herein should not be taken as to limit the scope of the present invention and include all other kinds of objects and/or fields with which the present invention could be used and may be useful, as apparent to a person skilled in the art.

Moreover, in the context of the present invention, the expressions "projectile", "bullet", "device", "product", "system", "method", "kit" and "assembly", as well as any other equivalent expressions and/or compounds word thereof known in the art will be used interchangeably, as apparent to a person skilled in the art. This applies also for any other mutually equivalent expressions, such as, for example: a) "projectile", "bullet", "Starchaser™", "system", "product", "assembly", "device", "apparatus", "unit", "component", "equipment", "add-on", "retrofit", etc.; b) "producing", "manufacturing", "assembling", "making", "processing", "altering", "modifying", "changing", etc.; c) "body", "shell", "chassis", "support", "frame", etc.; d) "removing", "reducing", "diminishing", etc. e) "drag", "resistance", "friction", etc.; f) "hollow", "cavity", "hole", "orifice", "recess", "grove", "slot", etc.; g) "channel", "conduit", "passage", "link", etc.; h) "tip", "extremity", "end", "distal", etc.; i) "cartridge", "propellant", "fuel", "explosive", "energetic material", etc.; j) "material", "substance", "solid", "liquid", "fluid", etc.; k) "blast", "explosion", "ignition", "propulsion", "expansion", "expulsion", "discharge", etc.; l) "gun gas", "combustion gas", "energy", "heat", etc.; m) "flight", "trajectory", "travel", "displacement", "movement", etc.; as well as for any other mutually equivalent expressions, pertaining to the aforementioned expressions and/or to any other structural and/or functional aspects of the present invention, as also apparent to a person skilled in the art. Also, in the context of the present description, expressions such as "can", "may", "might", "will", "could", "should", "would", etc., may also be used interchangeably, whenever appropriate, as also apparent to a person skilled in the art.

Furthermore, in the context of the present description, it will be considered that all elongated objects will have an implicit "longitudinal axis" or "centerline", such as the longitudinal axis of an elongated bullet, or the centerline of a hole, for example (and as a result, there is a "transversal axis" being substantially "perpendicular" for each longitudinal axis, etc.), and that expressions such as "connected" and "connectable", or "mounted" and "mountable", may be interchangeable, in that the present invention also relates to a kit with corresponding components for assembling a resulting fully-assembled and/or fully-operational bullet, for use with various types of weapons, such as rifles and the like (and/or the present invention also relates to a weapon provided with at least one of such bullet(s), to a kit for assembling the same (ex. bullet, weapon, associated accessory, etc.), and to corresponding methods of manufacturing, operating and/or use associated thereto, etc.).

Moreover, components of the bullet(s), weapon(s), associated accessory (ies) and/or steps of the method(s) described herein could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiment of the present invention as illustrated in the accompanying drawings may comprise various components, and although the preferred embodiments of the bullet, weapon, accessory and/or associated method(s) (ex. of manufacturing, assembling, operating, use, etc.) may consist of certain preferred steps and components as explained herein, not all of these steps and components are essential to the invention and thus should not be taken in their restrictive sense, i.e. should not be taken as to limit the scope of the present invention. It is to be understood, as also apparent to a person skilled in the art, that other suitable steps, components and cooperation thereinbetween, may be used for the present drag-reducing assembly (ies)/method(s) of a bullet and corresponding bullet (as well as corresponding components thereof) according to the present invention, as will be briefly explained hereinafter and as can be easily inferred herefrom by a person skilled in the art, without departing from the scope of the invention.

Other possible aspect(s), objective(s), embodiment(s), variant(s) and/or resulting advantage(s) of the present invention, all being preferred and/or optional, are briefly summarized hereinbelow.

For example, and as will be explained in greater detail hereinbelow, the present system is particularly advantageous in that, due to its components and features, the bullet is capable of considerably increasing ballistic performances (ex. more precise trajectory, much longer range, greater travelling speed, more powerful impact, etc.).

LIST OF NUMERICAL REFERENCES FOR SOME OF THE CORRESPONDING POSSIBLE COMPONENTS ILLUSTRATED IN THE ACCOMPANYING DRAWINGS

1. bullet system (or simply "bullet")
3. main body (and/or "projectile" of bullet system)
5. drag-reducing assembly (ex. common/shared drag-reducing assembly)
5*a*. first drag-reducing assembly
5*b*. second drag-reducing assembly
5*c*. third drag-reducing assembly
11. corresponding channel (ex. common and/or longitudinal channel)
11*a*. cavity (of first drag-reducing assembly)
11*b*. cavity (of second drag-reducing assembly)
11*c*. cavity (of third drag-reducing assembly)
11*d*. frontal orifice (ex. distal orifice—for discharge of operative vapor)
11*e*. rearward orifice (ex. exhaust orifice—for discharge of propellant)
13. propellant (ex. inside cavity of first drag-reducing assembly)
15. rearward cross-sectional profile (of first drag-reducing assembly)
17. frontward/inner cross-sectional profile (of first drag-reducing assembly)
23. sprayed-on energetic material
33. operative/activation material (ex. "operative/activation fluid" to be converted into "operative vapor discharge")
35. insertable capsule (ex. for operative/activation fluid)
37. barrier portion (of capsule)
39. plug (of capsule)
41. tube (for containing operative/activation material)
43. insert component (for distal tip of main body)
45. front end (of cavity of third drag-reducing assembly)
47. rear end (of cavity of third drag-reducing assembly)
49. shouldering portion (of cavity of third drag-reducing assembly)

Broadly described, and as better exemplified in the accompanying drawings, the present invention relates to a bullet that incorporates in its design three different drag-reducing capabilities (ex. devices, components, features, etc.) in order to reduce Base Drag, Frontal drag and/or Skin-Friction drag.

By reducing all possible sources of aerodynamic drag, the present Starchaser™ bullet can maintain nearly all kinetic energy at the point of impact located at about 1500 m to about 2000 m (approximately), as at the muzzle, with the help of impulse-assisted device that is part of the bullet.

Brief Overview of Preferred and/or Optional Features of the Present Starchaser™ Bullet:

Starchaser™ is a bullet of mono-block construction that is build using advanced techniques of additive manufacturing. Preferably and/or optionally, three are three sections in the Starchaser™ bullet. The rear section has a shape of empty propulsion/impulse nozzle with large diameter facing the back of the bullet. The inside of the nozzle has a sprayed-on energetic material. The small diameter is facing front of the bullet and the small diameter is actually an orifice to frontal cavity. The frontal cavity is in shape of an oval with two orifices at each end. The nose of the bullet is housing a cylindrical cavity, the centerline of which is the same as the longitudinal axis of the bullet.

Brief Description of the Functioning of the Present Starchaser™ Bullet:

At the ignition, the flame propagates inside the cartridge case and spreads into the propellant that is in the "Nozzle" of the Starchaser™ bullet. The effect is that as the bullet moves forward some of the propellent moves forward with the bullet resulting in "pressure vs time" curve that has no peak but looks more like gentle rise resulting in more area under the "pressure vs time" curve. This effect is called "travelling charge". The burning charge propellant ignites much slower burning energetic material grain that is on the inside of the "Nozzle". Under high acceleration, the liquid that is stored in cylindrical cavity in front of the bullet drops into frontal cavity right into oncoming gas from the rear. The result is that the liquid evaporates, and the vapors are pushed through cylindrical cavity in the nose to outside of the bullet. As vapors are lighter than ambient air, the rushing air outside of the barrel pushes the vapor on the bullet forming a boundary layer of vapor and prevent direct contact between air and surface of the bullet. The vapors that are around the bullet have lower density and viscosity than air and therefore form a "bubble" around the bullet and reduce frontal and skin drag. In the back of the bullet, the energetic material is burning reducing the base drag to near zero and propelling the bullet forward.

Brief Overview of the Technologies that are Involved with the Present System:

1) Internal ballistics of "travelling charge" more energy is transferred to the bullet ensuring high muzzle velocity;
2) External ballistics of partial cavitation;
3) Base Drag Reduction-and-Propulsion impulse-assisted projectile;
4) Mass distribution of the bullet ensures high level of gyroscopic stability; and
5) Advanced method of manufacturing using Additive Manufacturing ensures that the Starchaser™ bullet is a one-piece bullet.

Development program is designed in such a way that each technology is an "add-on" to the previous technology ensuring easy verification of the progress.

Sequence of Events in Building of the Starchaser™:

a) Design of Starchaser™ structure, ensuring structural integrity and stability in flight;
b) Manufacturing of Starchaser™ bullet by additive manufacturing; and
c) Test the Starchaser™ bullet for structural integrity and gyroscopic stability by firing it with high energy charge.

After successful completion of the above tasks, the present bullet system is capable of outperforming any commercially available bullet.

d) Spray energetic material on the inside of the "nozzle" that is the rear portion of the rear Starchaser™ bullet; and
e) Verify the performance of combination of two technologies, the technology of "travelling charge" combined with RAP technology. All related to internal ballistics.

After successful testing of all of the above technologies, the present bullet system enables to provide a fastest travelling bullet that can be sold to general public.

f) Introduce and test the low drag technology for frontal drag and skin friction together.

Brief Overview of Important Components and Features of the Present System, and Associated Resulting Advantages:

A) Ignition of propelling charge-Standard Ignition is initiated at the base of cartridge by a Squib that is impacted by the firing pin. The squib in turn initiates primer that ignites propellant charge. The Starchaser™ has significantly more propellant than standard load of equivalent weight bullet and to avoid a pressure wave compressing the forward located propellant grains, the ignition starts uniformly through a center of a tube located along central axis of the cartridge;

B) Geometry of the rear of the bullet-Shape of a propulsion/impulse nozzle. The rear has three distinct functions. The first function is to channel gun gas from burning of the propellant charge into an orifice located in the front of the nozzle. The second function is to support the bullet during its forward motion in the barrel and act as a obturator and a driving band. The third function is to serve as a nozzle and direct burning propulsion/impulse gas in opposite motion to the bullet;

C) In central portion of the interior of the bullet is a cavity with two orifices through the rear orifice gun gas enters into the cavity and from the front orifice a liquid under "G" loading drops into the cavity along cavity walls. The mixture of the liquid and gun gas causes liquid to vaporize and exits through the nose of the bullet;

With respect to Frontal Drag:

D) The vapor outside of the bullet meets high velocity air and forms a boundary layer between the bullet and the air. The vapor's lower density and viscosity will reduce frontal and skin friction drag between the bullet and the air. In addition, to retain the vapor to be attached to the skin of the bullet, the surface of the bullet will have certain roughness to retain vapor in contact with the surface of the bullet; and E) Reduction of frontal and body drag in addition to "non-existence" (i.e. effective reduction and/or suppression) of base drag and additional impulse propulsion will result in impact velocity of the bullet at 1500 m (approx.) be nearly the same as its muzzle velocity.

Brief Overview of Other Important Components and Features of the Present System, and Associated Resulting Advantages:

1) With Respect to "Reduction of Aerodynamic Drag":

a) Reduction of Frontal Drag (Cavitation) by surrounding the bullet with vapor of lower density and viscosity than air;

b) Reduction of effective surface of the bullet drag by surface roughness filled by vapor; and c) The is little/no Base Drag as we have impulse propulsion effect.

2) With Respect to "Propulsion":

a) Combination of propellant charge ignited by "uniform ignition", and impulse-effect propulsion. The inside of the nozzle roughness is maximized for retention of energetic material.

3) With Respect to "Gyroscopic Stability":

The outside and inside geometry are designed to maximize the ratio of "Axial moment of inertia" over "Transverse moment of inertia". Geometries of the cavities.

4) With Respect to "Aerodynamic Stability":

Combination of reduction of the frontal drag and rear impulse propulsion does not form destabilizing couple as the effects neutralize each other.

As may now be better appreciated, and as described and/or illustrated in the present patent specification, and/or as can be easily inferred therefrom, the present invention is advantageous in that is provides a way of "managing fluid flow inside of a projectile to reduce aerodynamic drag on the outside of the projectile", and the present bullet system (1) may come in the form of a bullet (1) including one and/or several of the following possible components and features (and/or different possible combination(s) and/or permutation (s) thereof):

i). A bullet system (1) for use with a cartridge for propelling out from a barrel of a weapon upon firing, the bullet system (1) comprising:

a main body (3) acting as a projectile;

a first drag-reducing assembly (5*a*) provided about a rearward portion of the main body (3), for providing the bullet (1) with a reduction of base drag during flight trajectory;

a second drag-reducing assembly (5*b*) provided about a frontward portion of the main body (3), for providing the bullet (1) with a reduction of frontal drag during flight trajectory; and a third drag-reducing assembly (5*c*) provided about an internal portion of the main body (3), for providing the bullet (1) with a reduction of skin drag during flight trajectory, the drag-reducing assemblies (5*a*, 5*b*, 5*c*) being fluidly connectable to one another via at least one corresponding channel (11), and at least one of said drag-reducing assemblies (5*a*, 5*b*, 5*c*) being provided with a material capable of being converted into an operative vapor discharge to be released from a corresponding orifice of the main body (3) of the bullet system (1) for covering the main body (3) of the bullet system (1) with said operative vapor discharge during flight, and thus, reducing an associated skin drag of the bullet system (1) during flight.

ii). A bullet system (1) according to any one of the preceding combination(s), wherein the first drag-reducing assembly (5*a*) is configured for being triggered upon a blast of propellant from the cartridge, in order to reduce a resulting base drag of the bullet (1) during flight trajectory.

iii). A bullet system (1) according to any one of the preceding combination(s), wherein the first drag-reducing assembly (5*a*) includes a cavity (11*a*) being disposed within the rearward portion of the main body (3), the cavity (11*a*) of the first drag-reducing assembly (5*a*) being positioned, shaped and sized for receiving and for containing therein additional propellant (13) to that of the cartridge.

iv). A bullet system (1) according to any one of the preceding combination(s), wherein a volume and associated additional propellant (13) of the cavity (11*a*) of the first drag-reducing assembly (5*a*) corresponds to at least n % of a volume of an original amount of propellant associated with (ex. present within, etc.) the cartridge, n being an integer greater than 1.

v). A bullet system (1) according to any one of the preceding combination(s), wherein a volume and associated additional propellant (13) of the cavity (11*a*) of the first drag-reducing assembly (5*a*) corresponds to about 25% more than a volume of an original amount of propellant associated with (ex. present within, etc.) the cartridge.

vi). A bullet system (1) according to any one of the preceding combination(s), wherein the cavity (11*a*) of the first drag-reducing assembly (5*a*) includes a geometrical profile of a nozzle, with a rearward portion of the cavity (11*a*) having a cross-sectional profile (15) (ex. area, interface, etc.) being greater than a cross-sectional profile (17) (ex. area, interface, etc.) of a frontward portion of said cavity (11*a*).

vii). A bullet system (1) according to any one of the preceding combination(s), wherein a ratio (ex. of surfaces, etc.) between the cross-sectional profile (15) of the rearward portion of the cavity (11*a*) of the first drag-reducing assembly (5*a*) and the cross-sectional profile (17) of the frontward portion of said cavity (11*a*) is about 5 (and/or is any other appropriate ratio, so as to ensure gun gas to "flow through" the corresponding orifice/interface (17,47) separating the associated cavities (11*a*, 11*c*), for the intended purpose(s) of the present bullet system (1), as can be easily understood by a person skilled in the art).

viii). A bullet system (1) according to any one of the preceding combination(s), wherein an inside of the cavity (11*a*) of the first drag-reducing assembly (5*a*) is covered with sprayed-on propellant (23) for providing the bullet system (1) with additional thrust during flight.

ix). A bullet system (1) according to any one of the preceding combination(s), wherein the first, second and third drag-reducing assemblies (5*a*, 5*b*, 5*c*) are fluidly connectable to one another via a common channel (11).

x). A bullet system (1) according to any one of the preceding combination(s), wherein the common channel (11) extends longitudinally along the main body (3) of the bullet system (1), from a rear portion of the main body (3) to a frontal portion of said main body (3).

xi). A bullet system (1) according to any one of the preceding combination(s), wherein the common channel (11) extends longitudinally along the main body (3) of the bullet system (1), from a rear portion of the main body (3) to a frontal orifice (11*d*) of said main body (3).

xii). A bullet system (1) according to any one of the preceding combination(s), wherein the common channel (11) extends longitudinally along the main body (3) of the bullet system (1), from a rear portion of the main body (3) to a frontal extremity of said main body (3).

xiii). A bullet system (1) according to any one of the preceding combination(s), wherein the common channel (11) extends longitudinally along the main body (3) of the bullet system (1), from a rear portion of the main body (3) to a distal extremity of said main body (3).

xiv). A bullet system (1) according to any one of the preceding combination(s), wherein the common channel (11) extends longitudinally along the main body (3) of the bullet system (1), from a rear portion of the main body (3) to a distal tip of said main body (3).

xv). A bullet system (1) according to any one of the preceding combination(s), wherein the common channel (11) extends along a substantially straight longitudinal axis (111) of the main body (3) of the bullet system (1).

xvi). A bullet system (1) according to any one of the preceding combination(s), wherein the third drag-reducing assembly (5*c*) includes a cavity (11*c*) being disposed within the internal portion of the main body (3), the cavity (11*c*) of the third drag-reducing assembly (5*c*) being positioned, shaped and sized for receiving a mixture of energy (ex. heat, etc.) from gun gas from the cartridge and corresponding blast thereof, and a corresponding activation fluid (33), in order to covert said activation fluid (33) into the operative vapor discharge to be released from a corresponding orifice (11*d*) of the main body (3) of the bullet system (1) for covering (ex. wrapping, engulfing, etc.) the main body (3) of the bullet system (1) with said operative vapor discharge during flight, and thus, reducing an associated skin drag of the bullet system (1) during flight.

xvii). A bullet system (1) according to any one of the preceding combination(s), wherein the activation fluid (33) is water in liquid form, and thus, wherein the resulting operative vapor discharge releasable from the corresponding orifice (11*d*) (ex. frontal and/or distal orifice) of the main body (3) of the bullet system (1) is water vapor.

xviii). A bullet system (1) according to any one of the preceding combination(s), wherein the activation fluid (33) is water in solid form (ex. ice, etc.), and thus, wherein the resulting operative vapor discharge releasable from the corresponding orifice (11*d*) of the main body (3) of the bullet system (1) is water vapor.

xix). A bullet system (1) according to any one of the preceding combination(s), wherein the corresponding orifice (11*d*) of the main body (3) of the bullet system (1) is provided about a frontward portion of the main body (3).

xx). A bullet system (1) according to any one of the preceding combination(s), wherein the corresponding orifice (11*d*) of the main body (3) of the bullet system (1) is provided about a frontward orifice (11*d*) of the main body (3).

xxi). A bullet system (1) according to any one of the preceding combination(s), wherein the corresponding orifice (11*d*) of the main body (3) of the bullet system (1) is provided about a frontward extremity of the main body (3).

xxii). A bullet system (1) according to any one of the preceding combination(s), wherein the corresponding orifice (11*d*) of the main body (3) of the bullet system (1) is provided about a distal extremity of the main body (3).

xxiii). A bullet system (1) according to any one of the preceding combination(s), wherein the corresponding orifice (11*d*) of the main body (3) of the bullet system (1) is provided about a distal tip of the main body (3).

xxiv). A bullet system (1) according to any one of the preceding combination(s), wherein the corresponding orifice (11*d*) of the main body (3) of the bullet system (1) is provided about a distal extremity of the at least one corresponding channel (11).

XXV). A bullet system (1) according to any one of the preceding combination(s), wherein the activation fluid (33) is provided in a capsule (35) being removably insertable into a corresponding cavity (11*b*) (ex. slot, recess, etc.) of the main body (3) of the bullet system (1).

xxvi). A bullet system (1) according to any one of the preceding combination(s), wherein the corresponding cavity (11*b*) (ex. slot, recess, etc.) is provided about a frontal portion of the main body (3) of the bullet system (1).

xxvii). A bullet system (1) according to any one of the preceding combination(s), wherein the corresponding cavity (11*b*) (ex. slot, recess, etc.) is provided about a frontal tip portion of the main body (3) of the bullet system (1).

xxviii). A bullet system (1) according to any one of the preceding combination(s), wherein the capsule (35) includes a barrier portion (37) (ex. a plug, wall, segment, etc.) being releasable (ex. released, opened, breakable, disengaged, dropped out, removed, etc.) as a result of a corresponding acceleration force (ex. a g-force) resulting from the blast of the cartridge so that the activation fluid (33) be released into the cavity (11*c*) of the third drag-reducing assembly (5*c*) when the bullet system (1) is propelled out of the barrel of the weapon.

xxix). A bullet system (1) according to any one of the preceding combination(s), wherein the barrier portion (37) includes a corresponding plug (39) being removable from the capsule (35) for discharging the activation fluid (33) to be released into the cavity (11*c*) of the third drag-reducing assembly (5*c*).

xxx). A bullet system (1) according to any one of the preceding combination(s), wherein the capsule (35) includes a tube (41) for containing the activation fluid (33) therein.

xxxi). A bullet system (1) according to any one of the preceding combination(s), wherein the capsule (35) is made of a polymeric material (ex. plastic, etc.).

xxxii). A bullet system (1) according to any one of the preceding combination(s), wherein the main body (3) of the bullet system (1) is made of a metallic material and/or corresponding alloy.

xxxiii). A bullet system (1) according to any one of the preceding combination(s), wherein the main body (3) of the bullet system (1) is made of a composite material.

xxxiv). A bullet system (1) according to any one of the preceding combination(s), wherein the capsule (35) is provided about a corresponding insert component (43) being insertable about a distal end of the main body (3) of the bullet system (1).

xxxv). A bullet system (1) according to any one of the preceding combination(s), wherein the corresponding insert component (43) includes a bullet tip being complementary to a shape of the main body (3) of the bullet system (1).

xxxvi). A bullet system (1) according to any one of the preceding combination(s), wherein the cavity (11*c*) of the third drag-reducing assembly (5*c*) is a oval-shaped cavity.

xxxvii). A bullet system (1) according to any one of the preceding combination(s), wherein the cavity (11*c*) of the third drag-reducing assembly (5*c*) includes a shouldering portion (49).

xxxviii). A bullet system (1) according to any one of the preceding combination(s), wherein the shouldering portion (49) includes at least one portion extending in a direction transversal to a longitudinal axis (111) of the main body (3) of the bullet (1).

xxxix). A bullet system (1) according to any one of the preceding combination(s), wherein the cavity (11*c*) of the third drag-reducing assembly (5*c*) includes front and rear ends (45,47), the rear end (45) of the cavity (11*c*) of the third drag-reducing assembly (5*c*) being fluidly connectable to the first drag-reducing assembly (5*a*) for receiving gun gas and associated energy from the blast of the propellant (ex. of the cartridge and/or of the cavity (11*a*) of the first drag-reducing assembly (5*a*)), and the front end (47) of the cavity (11*c*) of the third drag-reducing assembly (5*c*) being fluidly connectable to the second drag-reducing assembly (5*b*) for releasing operative vapor discharge via a corresponding orifice (11*d*) of the second drag-reducing assembly (5*b*), and resulting from a mixture of gun gas energy and activation fluid (33) inside the cavity (11*c*) of the third drag-reducing assembly (5*c*).

xl). A bullet system (1) according to any one of the preceding combination(s), wherein an outer surface of the main body (3) is provided with a given roughness in order to retain operative vapor discharge in contact with said outer surface of the bullet system (1) during flight.

xli). A bullet system (1) according to any one of the preceding combination(s), wherein main body (3) of the bullet system (1) is substantially symmetrical about a single axis, said single axis corresponding to the longitudinal axis (111) of the bullet system (1).

xlii). A bullet system (1) according to any one of the preceding combination(s), wherein the main body (3) of the bullet (1) is substantially elongated.

xliii). A bullet system (1) according to any one of the preceding combination(s), wherein the main body (3) of the bullet (1) includes an ogive-shaped portion.

xliv). A bullet system (1) according to any one of the preceding combination(s), wherein the main body (3) of the bullet (1) and associated drag-reducing assemblies (5*a*,5*b*,5*c*) are made of one single piece via additive manufacturing.

xlv). A kit with corresponding components for assembling a bullet system (1) according to any one of the preceding combination(s).

xlvi). A weapon having a barrel being provided with at least one bullet system (1) according to any one of the preceding combination(s).

xlvii). A weapon according to any one of the preceding combination(s), wherein an inside of the barrel of the weapon is treated with cold spray.

xlviii). A weapon according to any one of the preceding combination(s), wherein the weapon is selected from the group consisting of rifle, gun, handgun, machine gun, revolver, automatic weapon, and semi-automatic weapon xlix). A method of managing fluid flow inside of a projectile to reduce aerodynamic drag on an outside portion of the projectile, the method comprising the steps of:

a) providing a bullet system (1) and associated projectile (3) according to any one of the preceding combination (s);

b) igniting propellant (13) from the rearward portion of the main body (3) of the projectile (3) and releasing associated gas from said rearward portion of the main body (3) during flight, for providing the projectile (3) with a reduction of base drag during flight trajectory;

c) recuperating energy from ignited propellant (13), and using it to convert activation material (ex. activation fluid (33)) present in the projectile (3), into operative vapor discharge, via a corresponding change of state, in order to force a volumetric expansion of said activation material inside the main body of the projectile (3);

d) releasing operative vapor discharge from a corresponding orifice (11*d*) of the main body of the bullet system (1) for providing the projectile (3) with a reduction of frontal drag during flight trajectory; and e) covering the main body (3) of the projectile (3) with operative vapor discharge during flight, for providing the projectile (3) with a reduction of skin drag during flight trajectory.

As can easily understood by a person skilled in the art, several modifications, alterations and/or additions could be made to the various components and/or features of the present bullet system (1), without departing from the scope of the invention.

For example, and as mentioned above, according to a possible embodiment, a ratio (ex. of surfaces, etc.) between the cross-sectional profile (15) of the rearward portion of the cavity (11*a*) of the first drag-reducing assembly (5*a*) and the cross-sectional profile (17) of the frontward portion of said cavity (11*a*) is about 5, but it is worth mentioning also that this ratio could ultimately be any other appropriate one (and/or fraction(s) of ratio(s), etc.), so long as it ensures gun gas to appropriately "flow through" the corresponding orifice/interface (17,47) separating the associated cavities (11*a*, 11*c*), for the intended purpose(s) of the present bullet system (1), as can be easily understood by a person skilled in the art.

Indeed, it is worth mentioning also that the rate of flow of the gun gas through the bullet is an important factor to consider for the present bullet system (1), and that the rate of flow will depend mostly on the inside geometry of the bullet, etc. As way of a possible example, considering that the inside geometry can be a cone, for instance, the base of the cone is the "intake" of the gun gases. The cone is truncated at the top and it represents the orifice between the rear and frontal cavities (11*a*, 11*c*). The distance between the base of the cone and the orifice can be a unit "one". As can easily understood, the rate of the gas flowing inside the bullet will depend mostly on the ratio of the diameters of the base of the cone to the diameter of the orifice. Thus, according to a possible and/or preferred embodiment of the present bullet system (1), a ratio (ex. of surfaces, etc.) between the cross-sectional profile (15) of the rearward portion of the cavity (11*a*) of the first drag-reducing assembly (5*a*) and the cross-sectional profile (17) of the frontward portion of said cavity (11*a*) is about 5, so to ensure that gun gas appropriately flows through the corresponding orifice/interface (17,47) separating the associated cavities (11*a*, 11*c*), for the intended purpose(s) of the present bullet system (1), as can be easily understood by a person skilled in the art. In contrast, for a conventional bullet (ex. a 0.5 cal bullet), the base of the cone has a diameter of 0.35 inch, and the orifice diameter is 0.035 inch, and the distance between the base and the orifice is one inch, and thus, the ratio of the diameters is 10, which would most likely "choke" the flow, etc.

Regarding other possible modifications, alterations and/or additions that could be made to the various components and/or features of the present bullet system (1), one could ultimately use the present bullet system (1) with the Nose Tip (ex. plastic tip) being "removed" altogether, so as to let air into the cylindrical cavity of the main body of the bullet. In such an alternate embodiment, the bullet would be rapidly accelerating in the barrel, and ingests air that is in front of the bullet. That process would continue to some degree when bullet is outside the barrel. The ingested air would thus mix with hot gas in the frontal cavity and would/could be expelled forward by hot air in the frontal cavity (about 3000° C.). The mixture of air injected from the outside and super hot air will be less dense than the air outside the bullet, and therefore, such an embodiment would enable a reduction of the frontal drag and skin friction drag, as well.

According to another possible embodiment, the driving band can be made out of the same material as the bullet. The geometry of the driving band can be similar to the existing driving bands, but geometry is preferably/optionally a mesh of criss-cross ridges and grooves of about 0,001 inches (approximately).

According to another possible embodiment, the present bullet system (1), associated bullet and/or corresponding components thereof (ex. main body, driving band, etc.) is/are manufactured by a suitable additive manufacturing method, such as "powder bed fusion" and/or "binder jet", for example, as can also be easily understood by a person skilled in the art.

As may now be better appreciated, the present bullet system (1) is particularly advantageous in that it includes a series of drag-reducing assemblies (5*a*,5*b*,5*c*) that enable to provide the bullet (1) with reductions of base drag, frontal drag and/or skin drag, during flight and/or associated trajectory. Furthermore, the present bullet system (1) is also a considerable improvement over conventional bullets in that, contrary to conventional bullets that rely on internal "active" components (ex. propellants, etc.) which "burn/combust" during flight of the bullet, in order to produce the propulsion gas/fluid, the present bullet system (1) provides an innovative way of "managing fluid flow inside of a projectile to reduce aerodynamic drag on the outside of the projectile", by recuperating energy from the gun gas from the blast of the propellant of the cartridge, mixing it with air and/or a non-explosive material (stored inside the bullet) capable of being converted into an operative "vapor" discharge, to then release said operative "vapor" discharge from a corresponding orifice (ex. frontal orifice, etc.) of the main body (3) of the bullet system (1), so as to engulf the bullet (1) with a protective and associated drag-reducing "bubble" during flight, with said "bubble" consisting of the operative "vapor" discharge which is "lighter" (i.e. less dense) and "less viscous" than the ambient air through the bullet (1) is intended to travel, for a reduced overall aerodynamic drag of the bullet (1) during flight, and thus, improved ballistic performances. Indeed, the provision and discharge of such an operative "vapor" discharge which is "lighter" (i.e. less dense) than air, namely helps to reduce frontal drag, and the provision and discharge of such an operative "vapor" discharge which is "less viscous" than air, namely helps to reduce skin drag, etc.

As may now be better appreciated also, the present bullet system (1) is also a considerable improvement over conventional bullets in that, thanks to a suitable additive manufacturing method, such as "powder bed fusion" and/or "binder jet", for example, the bullet system (1) and associated drag-reducing assemblies (5*a*,5*b*,5*c*) can manufactured as a "single" and/or "unified/uniform" piece, which is advantageous for various reasons (in terms of costs, in terms of structural integrity, in terms of ballistic performance, etc.), contrary to conventional bullets that rely on various components being mechanical and/or thermally connected together, etc.

As may now be better appreciated also, the present bullet system (1) is also a considerable improvement over conventional bullets in that, the provision and discharge of the aforementioned operative "vapor" discharge during flight of the bullet (1) enables to have a bullet (1) having an effective flight geometry that is not "fixed" nor "rigid", due to said discharge of operative "vapor" during flight (ex. from a frontal orifice of the bullet), and thus, such fontal expulsion of operative "vapor" discharge during flight enables the bullet (1) to have an associated "variable" (i.e. non-fixed, non-rigid, etc.) effective geometry of the bullet (1) during flight, which is also advantageous in that it helps to reduce any possible resulting occurrence of shock wave(s), something that is not possible with conventional bullets that have "fixed" tips, and thus, due to speed(s) being travelled when fired, inherently result into shock wave(s), which is very undesirable from a "drag" point-of-view. Thus, the structural and functional design of the present bullet system (1), and associated drag-reducing assemblies (5*a*,5*b*,5*c*), as well a corresponding discharge/expulsion operative "vapor" from a frontal orifice of the bullet (1) during flight, helps to avoid possible resulting shock wave(s), and thus, advantageously helps to reduce an overall aerodynamic drag of the bullet (1) during flight, for improved ballistic performances, etc.

The present bullet system and corresponding parts are preferably made of substantially rigid materials, such as metallic materials, hardened polymers, composite materials, polymeric materials, and/or the like, so as to ensure a proper operation thereof depending on the particular applications for which the bullet system is intended and the different parameters (weights, loads, moments, etc.) in cause, as apparent to a person skilled in the art.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing form the scope and spirit of the present invention, as defined in the appended claims and as apparent to a person skilled in the art.

The invention claimed is:

1. A bullet system for use with a cartridge for propelling out from a barrel of a weapon upon firing, the bullet system comprising:

a main body acting as a projectile;

a first drag-reducing assembly provided about a rearward portion of the main body, for providing the bullet with a reduction of base drag during flight trajectory, the first drag-reducing assembly includes a cavity being disposed within the rearward portion of the main body, the cavity of the first drag-reducing assembly being positioned, shaped and sized for receiving and for containing therein additional propellant to that of the cartridge;

a second drag-reducing assembly provided about a frontward portion of the main body, for providing the bullet with a reduction of frontal drag during flight trajectory; and a third drag-reducing assembly provided about an internal portion of the main body, for providing the bullet with a reduction of skin drag during flight trajectory, the drag-reducing assemblies being fluidly connectable to one another via at least one corresponding channel, and at least one of said drag-reducing assemblies being provided with a material capable of being converted into an operative vapor discharge to be released from a corresponding orifice of the main body of the bullet system for covering the main body of the bullet system with said operative vapor discharge during flight, and thus, reducing an associated skin drag of the bullet system during flight.

2. A bullet system according to claim 1, wherein the first drag-reducing assembly is configured for being triggered upon a blast of propellant from the cartridge, in order to reduce a resulting base drag of the bullet during flight trajectory.

3. A bullet system according to claim 1, wherein a volume and associated additional propellant of the cavity of the first drag-reducing assembly corresponds to about 25% more than a volume of an original amount of propellant associated with the cartridge.

4. A bullet system according to claim 1, wherein the cavity of the first drag-reducing assembly includes a geometrical profile of a nozzle, with a rearward portion of the cavity having a cross-sectional profile being greater than a cross-sectional profile of a frontward portion of said cavity.

5. A bullet system according to claim 4, wherein a ratio between the cross-sectional profile of the rearward portion of the cavity of the first drag-reducing assembly and the cross-sectional profile of the frontward portion of said cavity is about 5.

6. A bullet system according to claim 1, wherein an inside of the cavity of the first drag-reducing assembly is covered with sprayed-on propellant for providing the bullet system with additional thrust during flight.

7. A bullet system according to claim 1, wherein the first, second and third drag-reducing assemblies are fluidly connectable to one another via a common channel extending longitudinally along the main body of the bullet system, from a rear portion of the main body to a frontal orifice of said main body.

8. A bullet system according to claim 1, wherein the third drag-reducing assembly includes a cavity being disposed within the internal portion of the main body, the cavity of the third drag-reducing assembly being positioned, shaped and sized for receiving a mixture of energy from gun gas from the cartridge and corresponding blast thereof, and a corresponding activation fluid, in order to convert said activation fluid into the operative vapor discharge to be released from the corresponding orifice of the main body of the bullet system for covering the main body of the bullet system with said operative vapor discharge during flight, and thus, reducing the associated skin drag of the bullet system during flight.

9. A bullet system according to claim 8, wherein the activation fluid is water in liquid form, and thus, wherein the resulting operative vapor discharge releasable from the corresponding orifice of the main body of the bullet system is water vapor.

10. A bullet system according to claim 8, wherein the activation fluid is water in solid form, and thus, wherein the resulting operative vapor discharge releasable from the corresponding orifice of the main body of the bullet system is water vapor.

11. A bullet system according to claim 8, wherein the corresponding orifice of the main body of the bullet system is provided about a frontward extremity of the main body.

12. A bullet system according to claim 8, wherein the activation fluid is provided in a capsule being removably insertable into the corresponding cavity of the main body of the bullet system.

13. A bullet system according to claim 12, wherein the capsule is provided about a corresponding insert component being insertable about a distal end of the main body of the bullet system, the corresponding insert component including a bullet tip being complementary to a shape of the main body of the bullet system.

14. A bullet system according to claim 1, wherein an outer surface of the main body is provided with a given roughness in order to retain operative vapor discharge in contact with said outer surface of the bullet system during flight.

15. A bullet system according to claim 12, wherein the capsule includes a barrier portion being releasable as a result of a corresponding acceleration force resulting from the blast of the cartridge so that the activation fluid be released into the cavity of the third drag-reducing assembly when the bullet system is propelled out of the barrel of the weapon.

16. A bullet system according to claim 15, wherein the barrier portion includes a corresponding plug being removable from the capsule for discharging the activation fluid to be released into the cavity of the third drag-reducing assembly.

17. A bullet system according to claim 12, wherein the capsule includes a tube for containing the activation fluid therein.

18. A bullet system according to claim 12, wherein the capsule is made of a polymeric material.

19. A bullet system according to claim 8, wherein the cavity of the third drag-reducing assembly is an oval-shaped cavity.

20. A bullet system according to claim 8, wherein the cavity of the third drag-reducing assembly includes a shouldering portion, the shouldering portion extending in a direction transversal to a longitudinal axis of the main body of the bullet.

* * * * *